US011687018B2

(12) United States Patent
Maccaferri

(10) Patent No.: US 11,687,018 B2
(45) Date of Patent: Jun. 27, 2023

(54) PNEUMATIC LEAK MEASUREMENT SYSTEM BASED ON ABSOLUTE PRESSURE DROP MEASUREMENT, WITH REFERENCE SAMPLE DIFFERENTIAL COMPENSATION

(71) Applicant: G.M.C. DI G. MACCAFERRI E CLAUDIO S.N.C., Modena (IT)

(72) Inventor: Claudio Maccaferri, Modena (IT)

(73) Assignee: G.M.C. DI G. MACCAFERRI E CLAUDIO S.N.C., Modena (IT)

( * ) Notice: Subject to any disclaimer, the term of this patent is extended or adjusted under 35 U.S.C. 154(b) by 0 days.

(21) Appl. No.: 17/413,536

(22) PCT Filed: Feb. 18, 2020

(86) PCT No.: PCT/EP2020/000044

§ 371 (c)(1),
(2) Date: Jun. 12, 2021

(87) PCT Pub. No.: WO2020/136582

PCT Pub. Date: Jul. 2, 2020

(65) Prior Publication Data

US 2022/0057735 A1 Feb. 24, 2022

(30) Foreign Application Priority Data

Feb. 21, 2019 (IT) ..... 102019000002505

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2039; G03G 15/2053; G03G 15/2064; G03G 15/6517; G03G 2215/2003
See application file for complete search history.

(56) References Cited

U.S. PATENT DOCUMENTS 9,638,559 B1 5/2017 Zummo et al.
2015/0241823 A1* 8/2015 Fukai ..... G03G 15/2017 399/70
2015/0316882 A1* 11/2015 Hara ..... G03G 15/6517 399/323
2016/0313681 A1* 10/2016 Matsuo ..... G03G 15/652

FOREIGN PATENT DOCUMENTS

DE 102 42 491 A1 5/2003

* cited by examiner

*Primary Examiner* — Thomas S Giampaolo, II
(74) *Attorney, Agent, or Firm* — John Alumit

(57) ABSTRACT

The object of the present invention is to fix the thermoplastic ink in powder state used to print digital images by means of an electrographic laser motor on self-adhesive web media such as self-adhesive paper webs, self-adhesive film webs such as polypropylenes, polyethylenes, polyesters, and vinyls, with different thicknesses and finishes, allowing work to be stopped between one production batch and another and/or stops for self-calibration of the print motor without changing the self-adhesive media, preventing problems due to overheating of the printout. The apparatus according to the present invention makes it possible to enhance the fixed prints with a glossy, matt, or holographed finish, without the need for subsequent treatment and/or the use of chemical materials afterwards, offering greater flexibility and economy at work.

13 Claims, 4 Drawing Sheets

PNEUMATIC LEAK MEASUREMENT SYSTEM BASED ON ABSOLUTE PRESSURE DROP MEASUREMENT, WITH REFERENCE SAMPLE DIFFERENTIAL COMPENSATION

The object of the present invention is to fix the thermoplastic ink in powder form used to print digital images by means of an electrographic laser print motor on self-adhesive media reels such as reels of self-adhesive paper and reels of self-adhesive film, such as polypropylene, polyethylene, polyester, and vinyl films, with different thicknesses and finishes, allowing work to be stopped between one production batch and another and/or stops for self-calibration of the print motor without changing the self-adhesive media, preventing problems due to overheating of the print-out. The apparatus according to the present invention makes it possible to enhance the fixed prints with a glossy, matt, or holographed finish, without the need for subsequent treatment and/or the use of chemical materials afterwards, offering greater flexibility and economy at work.

DESCRIPTION OF THE FIGURES AND THE APPARATUS

The embodiment of the invention illustrates the fixing and finishing apparatus shown in FIGS. 1-2-3-4.

Figure 1:
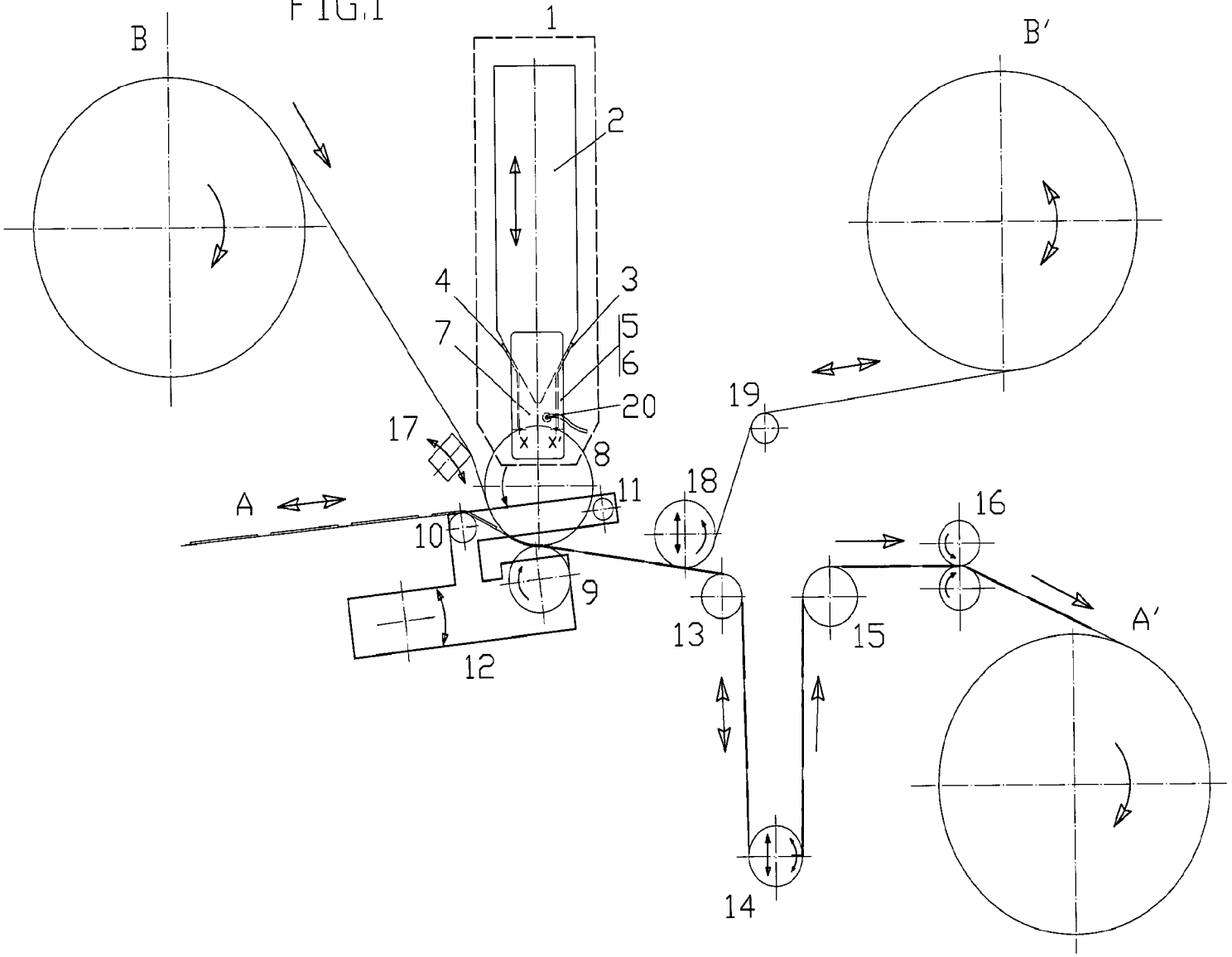
FIG. 1 illustrates a first configuration of the apparatus for fixing and finishing digital images printed with toner on self-adhesive materials on reels by means of a hot roller heated by forced ventilation of confined air with first and second pins in positions of minimum thrust.

In more detail, the fixing and finishing apparatus illustrated in FIGS. 1-2-3-4 includes:

1) Means of conveying the self-adhesive material A, made of either paper or plastic film, with digital images printed thereon using thermoplastic ink or toner, by means of an electro-graphic laser print motor which is inserted into the apparatus of the present invention with the toner in an as-yet non-fixed powder form, wherein this material has a two-way movement which is synchronous with the electrographic laser print motor, wherein the return movement towards the print motor allows the position between the images printed on the film to be adjusted, reducing the space between the printed images until they are printed consecutively; in more detail, the aforesaid material A is wound back onto a reel A' located beyond the fixing apparatus, at the outlet of the electrographic laser printing machine;
2) Means of conveying a non-stick material B, defined as "intermediary", which acts as an interface between the self-adhesive material A and the hot roller 8 in the fixing system, helping to protect the self-adhesive material against overheating during printing breaks and to lend the toner a glossy, matt, or holographic finish, as required. This film, which may have, for example, silicone PET on one surface, with a thickness of preferably 10 to 30 microns, must be in contact with the toner to be fixed to the self-adhesive medium on the silicone surface. In more detail, the aforesaid non-stick material B is unwound from a respective parent reel, driven through the coupling of rollers 8 and 9 (described in detail below), and is rewound onto a reel B' which moves synchronously with the self-adhesive material A, which is free during the return movement; in other words, the reel B' is equipped with a controlled motorisation which performs controlled winding and free unwinding;
3) A fixing roller, or hot roller, denoted with 8 in the figure, whose function is to melt the toner and fix it to the self-adhesive material through the pressure exerted by the unheated opposite roller 9; the hot roller 8 consists of a core made of aluminium or another material with low specific weight and low volume; the said core is therefore coated with a highly non-stick silicone rubber with a hardness of 70-90 shr and a thickness of preferably between 1 mm and 5 mm; in addition there is a high degree of surface finish and a heat resistance of up to 250° C.
4) A roller 9, also called a cold roller as it is not heated, which is opposite the hot roller 8; the said roller 9 consists of a core made of aluminium or another material with low specific weight and low volume, coated with highly non-stick silicone rubber with a hardness of 70-90 shr and thickness of between 1 mm and 5 mm, a high degree of surface finish, and a heat resistance of up to 250° C.

The hot roller 8 is endowed with continuous rotary motion and a fixed position, while the cold roller 9 is endowed with rotary motion driven by the movement of the hot roller 8, thanks to the lever mechanism 12 which puts the said cold roller 9 in contact with the said hot roller 8.
5) A hot air generator blower 1, known as a fusing unit, which comprises at least one chamber for conveying 2 the air delivered by a blower with adjustable flow and pressure, at least one confinement chamber 7, which keeps the hot air close to the surface of the hot roller 8, which is endowed with continuous rotary motion and whose rotation speed is adjustable, wherein the air is heated by means of adjustable electric resistors.
6) A lever mechanism unit 12 comprising at least the roller 9 and two further pins 10 and 11, wherein the pin 10 can be used to better guide the self-adhesive material A according to the printing speed and the conveyability characteristics of the said material (FIGS. 1-3), while the function of the pin 11 is to compress the intermediate material against the self-adhesive material, facilitating removal of the self-adhesive material from the hot roller 8.

The said lever mechanism unit 12 is configured to control the said roller and pins synchronously with the print motor and enable the toner to melt and adhere; this is due to the movement of the lever mechanism unit 12 which, in a first configuration, ensures the pressure roller 9 is compressed against the hot roller 8, thereby pulling the self-adhesive material A.
7) A return unit comprising:
   a. A first deflector roller 13 with adjustable braking of the self-adhesive film with fixed toner images printed thereon, b. A "dancer" roller denoted 14, configured to allow a reserve of printed film during the reverse-traction of the self-adhesive film A, c. A second deflector roller 15 with adjustable braking of the self-adhesive film with fixed toner images printed thereon, d. Pinch rollers 16, for the printed film, motorised to pull the self-adhesive material towards the reel A' (self-adhesive material with fixed and enhanced digital toner images printed thereon), the latter equipped with controlled motorisation.

8) A compression element 17, which compress the intermediate film B against the hot roller 8, has a cusp geometry and is endowed with angular motion to force the intermediate material into sufficient contact with the hot roller (based on the degree of heating of the said roller) to impart heat to the intermediate material B so that the hot roller 8 is hot enough to melt the toner to be fixed to the self-adhesive medium, wherein the quantity of heat to be imparted to the intermediate B film is adjustable according to the self-adhesive material used, the toner melting temperature, and the desired print finish e.g. glossy or matt;

The conveying chamber 2 of the fusing unit 1 is characterised by a cusp-shaped outlet section endowed with a slot which is as long as the conveying chamber, i.e. a triangular section slotted along the entire length of the conveying chamber from which the hot air flows out towards the hot fixing roller 8 and is kept inside the confinement chamber 7, defined by side walls 3 and 4, a front wall 5, a rear wall 6, and the adjacent hot roller 8. Thus the aforesaid fusing unit 1 keeps the blown hot air against a surface portion XX' of the roller 8.

The said portion XX' will be sized according to the speed imparted to the roller 8 and the thermal energy that must be imparted thereto.

Furthermore, thanks to the confinement chamber 7, heat transfer to the surface of the said hot fixing roller 8 is maximised and heat dispersion is minimised.

Furthermore, the aforementioned fusing unit 1 is configured so that the temperature, air flow, and position thereof with respect to the hot roller 8 are adjustable in order to impart the necessary energy to the external surface of the hot roller 8.

According to one aspect of the invention, the non-stick material film B is preheated, in an adjustable manner, to ensure the fixing roller 8 is at the right temperature to fix the toner to the medium and to enhance it at the same time through the finish imparted by the said intermediate material B.

According to a further aspect of the invention, the generator 1 comprises a temperature sensor 20 (for example a thermocouple) integrated into the system, which ensures precision in the continuous control of the hot air; the temperature of the hot air blown can go up to 400° C. since the system power is adjustable.

As stated earlier, the pins 10 and 11 are part of the lever mechanism unit 12, the said unit being configured to be positioned in two configurations, namely:

1) the first configuration (FIGS. 1 and 3), with pin 11 raised and pin 10 in a position of either minimum thrust (FIG. 1) or zero thrust (FIG. 3) against the self-adhesive material A, and roller 9 in contact with and applying pressure to the roller 8, in which the self-adhesive film A moves towards the hot roller 8 and couples with the intermediate film B during the melting and fixing of the toner;

2) the second configuration (FIGS. 2 and 4), with pin 11 applying pressure to both materials, pin 10 positioned so that it is pushing against the self-adhesive material A coupled with the intermediate material (FIG. 2) or pin 10 only tangent to the intermediate material (FIG. 4), roller 9 detached from the melting roller 8, which results in the self-adhesive material A being stretched and detached from the hot roller 8, mediated by the intermediate material (FIGS. 2 and 4), this allows for breaks during the printing process and/or during the reverse-traction of the self-adhesive material, thereby preventing the printed self-adhesive medium from overheating.

Figure 2:
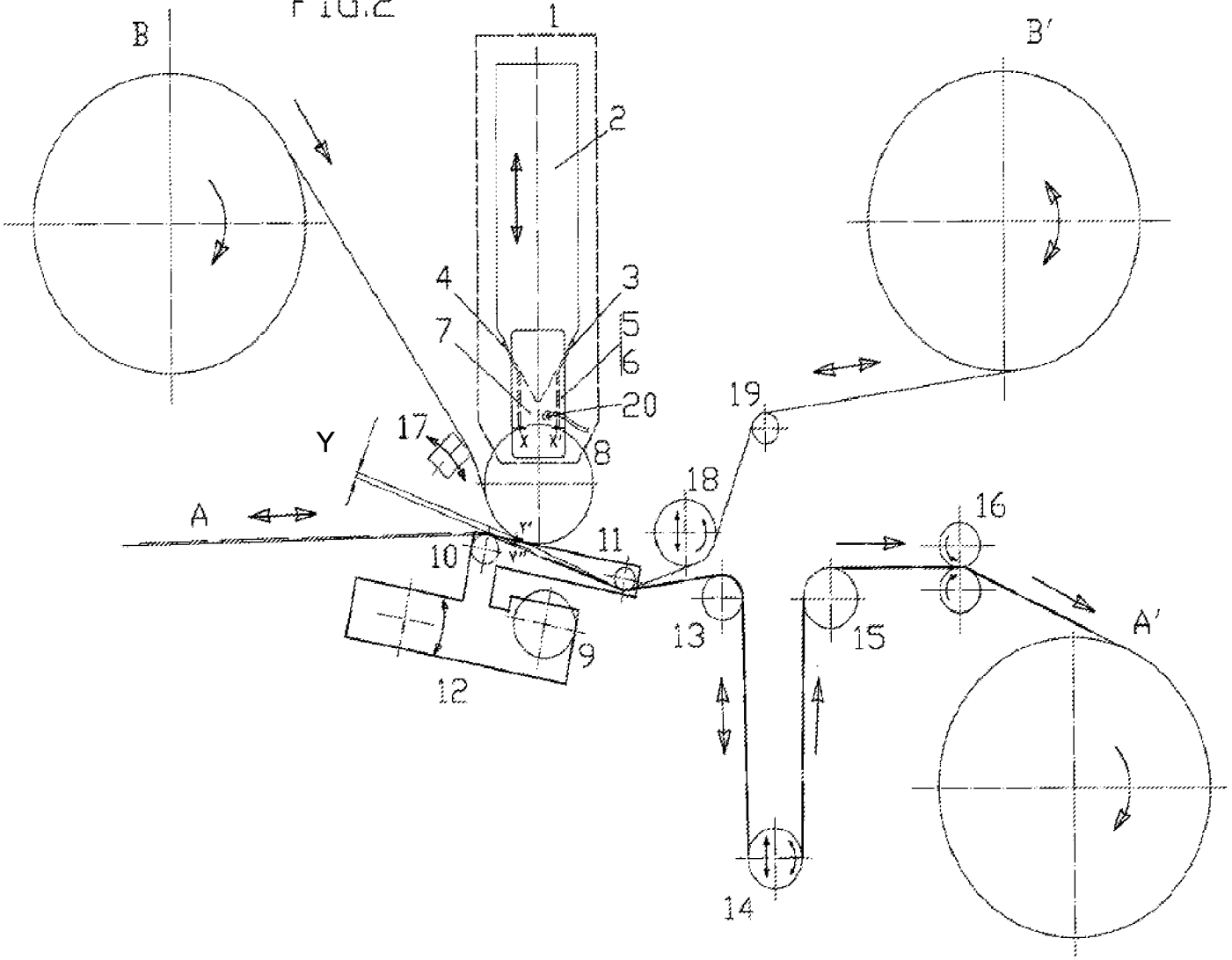
FIG. 2 illustrates a second configuration of the apparatus where a first pin applies pressure to a self-adhesive film and an intermediate film, and a first pin is positioned so as to push against the self-adhesive material coupled with the intermediate material.
Figure 3:
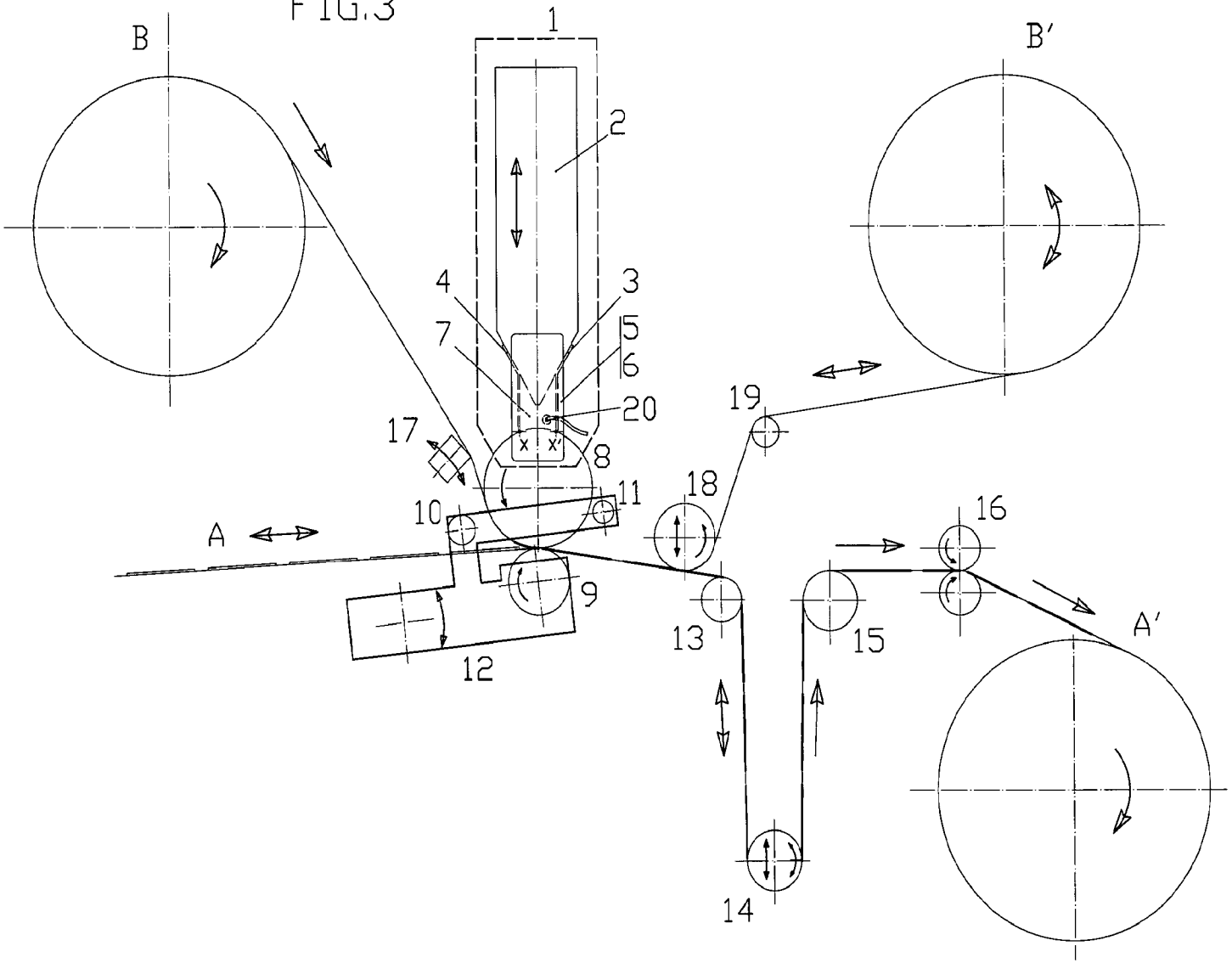
FIG. 3 illustrates the first configuration of the apparatus for fixing and finishing digital images printed with toner on self-adhesive materials on reels by means of a hot roller heated by forced ventilation of confined air with the pins in a position of zero thrust.
Figure 4:
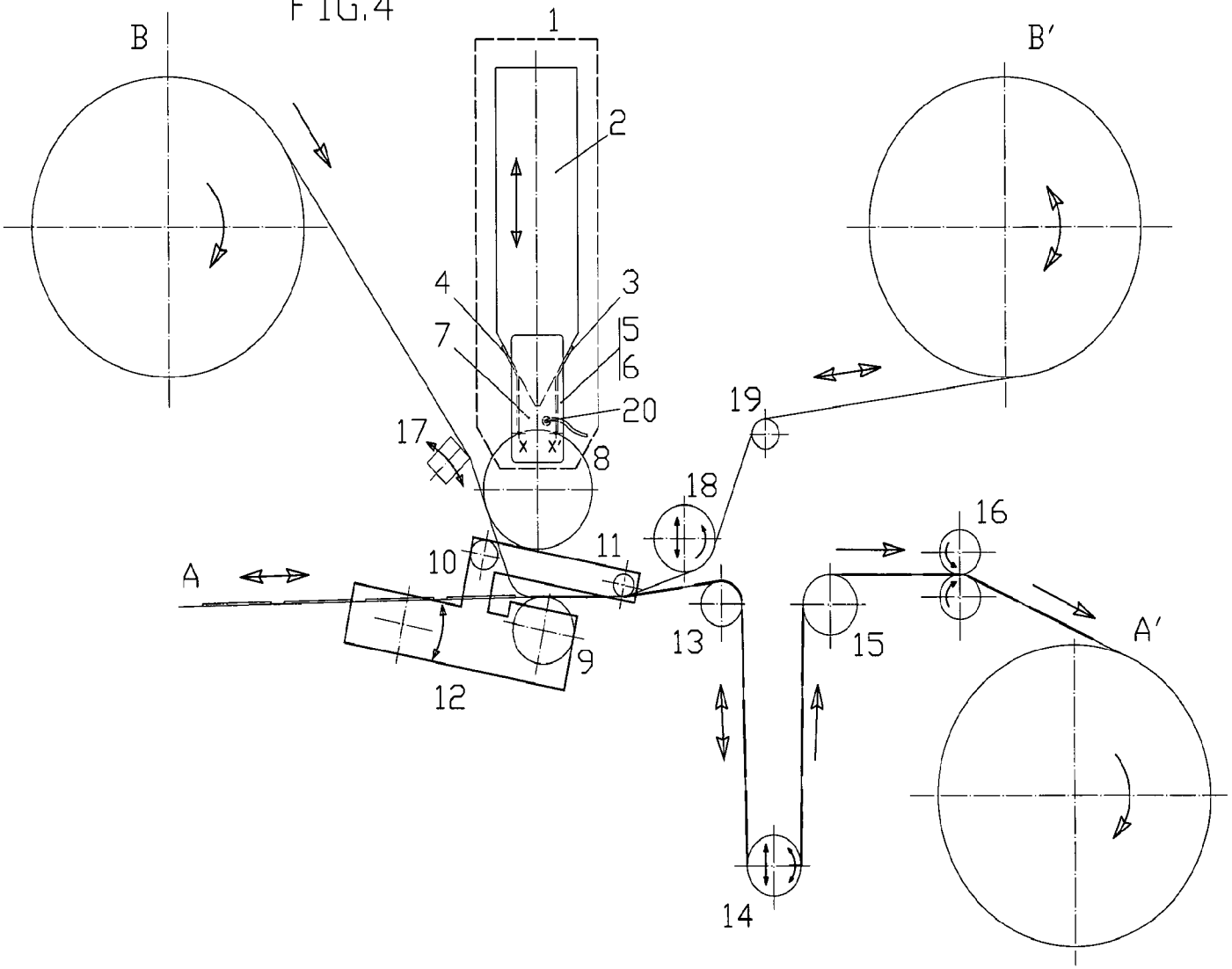
FIG. 4 illustrates the second configuration of the apparatus where a first pin applies pressure to a self-adhesive film and an intermediate film, and a second pin is tangent to the intermediate material.

From that just described, it is clear that if the self-adhesive material is guided by the said pin (FIGS. 1 and 2), the action of the pin 11, together with that of the pin 10, detaches the self-adhesive material from the hot roller stated in FIG. 2 y'y", preventing the self-adhesive medium from overheating;

The system described here also relates to a neutral roller 18 with a vertical and adjustable position, for guiding the intermediate film B and an intermediate film deflector roller 19 with adjustable brake (FIGS. 1, 2, 3, 4)

Operation

A self-adhesive material (A) printed with thermoplastic ink or toner, using an electro-graphic laser print motor (not shown) is conveyed towards the fixing and finishing apparatus, pulled in a controlled manner, synchronously with the print motor, where the toner is found in powder form.

The melting apparatus essentially consists of the fusing unit 1 with the conveying chamber 2 for the hot air blown by means of a blower pump with adjustable flow, wherein heating is obtained by means of adjustable electrical resistors, wherein the said conveying chamber has a slotted cusp section from which the hot air exits to be contained in a confinement chamber 7 defined by the side walls 3 and 4, the front wall 5, the rear wall 6, and an adjacent portion of the hot roller 8, wherein the said fusing unit keeps the hot air against a portion XX' of the roller 8, the said hot fixing roller minimising heat dispersion and maximising the energy transferred to the surface of the highly non-stick silicone rubber.

The printed self-adhesive material A, possibly led by the guide pin 10, pulled towards the melting and fixing apparatus, passes (in an integral manner with the intermediate material B, which has been preheated by contact with the hot roller 8 thanks to the pressure element 17) between the hot fixing roller 8 and the cold pressure roller denoted 9 which, thanks to the lever mechanism unit 12, are in contact and ensure the toner is fixed to the self-adhesive material. Contact with the intermediate material gives the toner a glossy, matt, or holographic finish, depending on the finish of the intermediate material B.

During the reverse-traction stage of the printed and fixed material (self-adhesive material A take-up stage) and/or during work breaks, the opposite movement of the lever mechanism unit 12 moves the pressure roller 9 away from the fixing roller 8, while the pin 11 (which is pressing against the coupled materials, but detached due to the effect of the silicone located on the surface of the intermediate materials in contact with the toner and possibly opposed to the thrust of the pin 10, which is the guide pin for the self-adhesive material) moves the self-adhesive material away from the hot roller as far as is necessary to protect the printed material from the heat.

ADVANTAGES

The fixing and finishing apparatus according to the present invention allows the decoration of rolls of self-adhesive paper or plastic film material with different chemical and physical characteristics as it allows the fixing temperature of the toner to be changed quickly and in a controlled manner thanks to heating by means of air hot blown and confined directly against the external surface of the fixing roller, which must acquire the temperature required to melt and fix the toner in the outermost layer thereof, the layer in contact with the toner, mediated by the preheated intermediate material, unlike with fixing devices used today, which spread the heat over the external surface of the fixing roller starting from the inside of the roller, by means of lamps or electrical induction, the said systems being characterised by high thermal inertia and which require a pressure roller which is also heated, such conditions preventing prolonged breaks and not allowing discontinuous work unless the adhesive media is allowed to overhead, resulting in damage to the print. The fixing and finishing apparatus according to the present invention allows the decoration of rolls of self-adhesive paper or plastic film material with different chemical physical characteristics as it allows the temperature of the fusing unit to be changed quickly and in a controlled manner by changing various variables, such as: fusing unit positioning, air flow control, heating element control, pressure roller position, and use of the intermediate material to obtain the print finishing in a single process, thereby maximising the flexibility of the production system. The fixing and finishing apparatus according to the present invention has environmental protection features since most commercial toners have a fixing temperature of between 90° C. and 150° C.; this leads to reduced electricity consumption due to the efficiency of the fixing system featuring forced, confined hot air.

Current devices fix the toner but cannot enhance it at the same time, and this dual aspect makes it possible to avoid the use of lacquers or other chemical products and to make the printing process faster and more productive.

The invention claimed is:

1. An apparatus for fixing digital images printed with thermoplastic ink or powder toner on self-adhesive material (A) on a reel (A'), with different thicknesses and finishes, the said apparatus used to print digital images by means of an electrographic laser print motor, characterised by the fact that the said apparatus comprises at least one hot roller (8) for fixing the toner and at least one unheated pressure roller (9), opposite the said hot roller (8), and at least one hot air conveying chamber (2) having a cusp-shaped outlet section slotted towards at least one confinement chamber (7) adjacent to an external surface portion XX' of the said hot roller (8).

2. An apparatus according to claim 1 wherein the hot roller (8) is endowed with continuous rotary motion whose speed, which is adjustable according to the laser motor print speed, determines the size of the external surface portion XX' of the hot roller (8) contiguous to the confinement chamber and therefore the thermal energy imparted thereto, the said hot roller (8) having a fixed position, while the pressure roller (9), which is not heated, is endowed with rotary motion driven by contact with the hot roller (8) and a mobile position controlled by an associated lever mechanism unit (12).

3. An apparatus according to claims 1 or 2 wherein the said lever mechanism unit (12) comprises, in addition to the pressure roller (9), two further pins (10) and (11) and is mobile in order to:

a. Place the pressure roller (9) in contact with the said hot roller (8), b. Use the pin (10) as a guide for the self-adhesive material (A), thereby facilitating the entry thereof between the said rollers (8, 9) in a way which depends on the printing speed and the conveyability characteristics of the material;

c. Allow the self-adhesive material (A) to come away from the hot roller (8), due to pressure exerted by the pin (11) against coupled (intermediate/self-adhesive) materials which have come away due to an effect of silicone located on the surface of the intermediate material and in contact with the toner, the said pressure being opposed by thrust imparted by the pin (10) against the self-adhesive material (A), during printing breaks and/or during reverse-traction of the self-adhesive film (A) when the pressure roller (9), which is not heated, is not in contact with the hot roller (8).

4. An apparatus according to claim 1 wherein the said rollers (8, 9) comprise a core coated with silicone rubber.

5. An apparatus according to claim 1 wherein the conveying chamber (2) of a generator (1) comprises electrical resistors and collects the air sent by an blower with adjustable flow and pressure and conveys the said air, via its outlet section, into the confinement chamber (7).

6. An apparatus according to claim 1 wherein the confinement chamber (7), defined by side walls (3) and (4), a front wall (5), and a rear wall (6) adjacent to the hot roller (8), keeps the hot air against the external surface portion XX' of the hot roller (8), thereby minimising heat dispersion.

7. An apparatus according to claim 1, comprising a temperature sensor (20), for continuous control of the temperature of the hot air in the confinement chamber (7).

8. An apparatus according to claim 1, characterised by the fact that the said apparatus comprises means for conveying the said self-adhesive material (A), which enters the apparatus with the toner powder, the said means being suitable to enable the self-adhesive material (A) to perform a two-way movement synchronously with the electrographic laser print motor, wherein the return movement towards the print motor allows the position between the printed images to be adjusted, reducing the space between the printed images until they become consecutive, the said self-adhesive material (A) being wound back onto a reel (A').

9. An apparatus according to claim 1, characterised by the fact that the said apparatus comprises means for conveying a non-stick material (B) configured to place the said material (B) in contact with the toner to be fixed onto the self-adhesive material (A) on a silicone-coated surface, the said non-stick material (B) being first unwound from a respective parent reel, is pulled by means of the coupling of the rollers (8) and (9) and wound back onto a reel (B'), wherein the said material gives the printed image a glossy, matt, or holographic finish depending on the surface finish of the intermediate material (B).

10. An apparatus according to claim 1, further comprising:

a. A first deflector roller (13) with adjustable braking of the self-adhesive material (A) with fixed toner images printed thereon, b. A dancer roller (14), configured to allow a reserve of printed material during the reverse-traction of the self-adhesive material (A), c. A second deflector roller (15) with adjustable braking of the self-adhesive material (A) with fixed toner images printed thereon, d. Traction rollers (16) to pull the self-adhesive material (A), the said traction rollers (16) being motorised to pull the material towards the reel (A'), said reel (A') being endowed with a controlled motorisation.

11. An electrographic machine for printing self-adhesive paper or plastic material (A) on reels comprising the apparatus for fixing digital images according to claim 1.

12. A method for fixing toner to self-adhesive material (A) made of either paper or plastic films with different thicknesses and finishes comprising the following steps:

1) digital images are printed using thermoplastic ink or toner on the said material (A); and 2) the said material (A) is run between a fixing roller (8) and an unheated roller (9);

wherein heat is applied, by means of hot air, to the external surface of the fixing roller (8) which is then positioned counter to the unheated roller (9).

13. A method according to claim 12, wherein a non-stick material (B), in the form of a silicone-coated, pre-heated material, is interposed between the said rollers (8) and (9).

* * * * *